United States Patent [19]

Shimizu et al.

[11] 4,187,078

[45] Feb. 5, 1980

[54] COAL DISPERSING OIL

[75] Inventors: Hirozumi Shimizu; Taizo Igarashi; Takaharu Ishizaki; Toshio Koma; Hideki Takahashi, all of Amagasaki, Japan

[73] Assignee: Nippon Oil and Fats Company, Limited, Tokyo, Japan

[21] Appl. No.: 840,096

[22] Filed: Oct. 6, 1977

[30] Foreign Application Priority Data

Oct. 13, 1976 [JP] Japan ..... 51/121906
Oct. 22, 1976 [JP] Japan ..... 51/126306

[51] Int. Cl.[2] ..... C10L 1/32
[52] U.S. Cl. ..... 44/51
[58] Field of Search ..... 44/51

[56] References Cited

U.S. PATENT DOCUMENTS

| | | | |
|---|---|---|---|
| 1,390,230 | 9/1921 | Bates | 44/51 |
| 2,397,859 | 4/1946 | Hersberger et al. | 44/51 |
| 2,550,982 | 5/1951 | Eberz | 44/51 |
| 2,873,182 | 2/1959 | Kosmin | 44/51 |

*Primary Examiner*—Delbert E. Gantz
*Assistant Examiner*—Y. Harris-Smith
*Attorney, Agent, or Firm*—Stevens, Davis, Miller & Mosher

[57] ABSTRACT

Coal dispersing oil compositions containing 10–90% by weight of a petroleum oil, 10–90% by weight of coal powders and 0.01–5% by weight of at least one surface active agent selected from phosphoric esters, salts of phosphoric esters, organic sulfonic acids, salts of organic sulfonic acids, sulfuric esters and salts of sulfuric esters.

10 Claims, No Drawings

COAL DISPERSING OIL

The present invention relates to a coal dispersing oil wherein coal powders are dispersed in a petroleum oil.

The energy source which until now has been chiefly used, is petroleum, but the amount of petroleum in reserve is limited and the amount consumed is large, so that there is fear that petroleum will soon be exhausted. Accordingly, the attempt to effectively utilize coal, which is, present abundantly throughout the world, has been actively made, and study regarding gasfication and liquefaction of coal has been ardently pursued, but a long period of time will be necessary before the use of such techniques becomes practical.

On the other hand, as a technique capable of being practically used in the near future, coal dispersing oil, wherein coal and petroleum are mixed is of interest. Coal dispersing oil is a fuel in which coal powders and a petroleum oil are mixed and a dispersing agent is added thereto to form a homogeneous dispersion that keeps for a long time. This coal dispersing oil can be handled and burned in the same manner as normal liquid fuel and is considered to be likely to be useful in the future for uses such a furnace of a power plant and a large size boiler, wherein a large amount of petroleum is burned, because petroleum would thereby be saved.

However, in the coal dispersing oils heretofore examined, coal powders, a petroleum oil, and water are mixed to form a gelation or thixotropic emulsion (U.S. Pat. No. 3,617,095, U.S. Pat. No. 3,210,168, U.S. Pat. application Ser. No. 518,509). It is said that this is effective for decreasing nitrogen oxides in the exhaust gas, but this is disadvantageous in view of the combustion efficiency or the difficulty of transporting large amounts thereof.

The inventors have diligently studied this matter, and have found that a coal dispersing oil wherein coal powders are stably dispersed in a petroleum oil for a long period of time by using a particularly defined surface active agent as the dispersing agent can be obtained.

That is, the present invention is a coal dispersing oil composition containing 10–90% by weight of a petroleum oil, 10–90% by weight of coal powders and 0.01–5% by weight of at least one surface active agent selected from phosphoric esters, salts of phosphoric esters, organic sulfonic acids, salts of organic sulfonic acids, sulfuric esters and salts of sulfuric esters.

Phosphoric esters useful as the dispersing agent are phosphoric esters of capryl alcohol, 2-ethylhexyl alcohol, lauryl alcohol, stearyl alcohol, oleyl alcohol and the like; phosphoric esters of addition compounds of alkylene oxides, such as ethylene oxide or propylene oxide and compounds having active hydrogen, such as these alcohols or alkyl phenols, fatty acids, fatty acid amides, and fatty acid partial esters of polyhydric alcohols. These phosphoric esters can easily be obtained by reaction of alcohol or alkylene oxide addition compounds with phosphorous pentoxide.

The salts of phosphoric esters include metal salts and amine salts of the above described phosphoric esters and as the metal salts, use may be made of various metal salts, such as lithium, sodium, potassium, magnesium, calcium, barium, zinc, aluminum and iron salts, and as the amine salts, use may be made of various aliphatic or aromatic amine salts, such as ammonium, methylamine, butylamine, laurylamine, stearylamine, oleylamine, dimethylamine, dibutylamine, dimethyllaurylamine, ethylenediamine, diethylenetriamine, monoethanolamine, diethanolamine, triethanolamine, morpholine, aniline and benzylamine salts.

Organic sulfonic acids include alkyl esters of sulfosuccinic acid, alkenyl esters of sulfosuccinic acid, alkane sulfonic acids, olefin sulfonic acids, alkylbenzene sulfonic acids, alkylphenol sulfonic acids, naphthalene sulfonic acid, $\alpha$-sulfonated fatty acids, $\alpha$-sulfonated fatty alkyl esters, and petroleum sulfonic acid.

Salts of organic sulfonic acids include metal salts and amine salts of the above described organic sulfonic acids, and the metal salts include salts of lithium, sodium, potassium, magnesium, calcium, barium, aluminum and zinc; the amine salts include salts of aliphatic amines or aromatic amines, such as ammonium, methylamine, butylamine, laurylamine, stearylamine, oleylamine, dimethylamine, monoethanolamine, diethanolamine, triethanolamine, ethylenediamine, diethylenetriamine, morpholine, aniline and benzylamine salts.

Sulfuric esters include sulfuric esters with alcohols, sulfuric esters with alkylphenols, sulfuric esters with polyoxyalkylene alkyl ethers, sulfuric esters with polyoxyalkylene alkylphenyl ethers, sulfuric esters of polyoxyalkylene fatty esters, sulfated fatty oil, and sulfated tall oil.

Salts of sulfuric esters include metal salts and amine salts of the above described sulfuric esters and the metal salts include salts of lithium, sodium, potassium, magnesium, calcium, barium, zinc and aluminum, and the amine salts include aliphatic amine salts and aromatic amine salts, such as ammonium, methylamine, butylamine, laurylamine, stearylamine, oleylamine, dimethylamine, monoethanolamine, diethanolamine, triethanolamine, morpholine, ethylenediamine, diethylenetriamine, aniline and benzylamine salts.

These surface active agents may be used alone or as an admixture of at least two surface active agents.

Coals to be used in the present invention may be coals produced in any country. The particle size is preferred to be 1–100$\mu$.

Petroleum oils to be used in the present invention may be any of crude oil, fuel oil and gas oil having a pour point of lower than 50° C. and a boiling point of higher than 30° C., and may be produced in any country.

The coal dispersing oil compositions of the present invention are produced by previously first dissolving the dispersing agent in the petroleum oil and then adding coal powders thereto and stirring and mixing the resulting mixture, or by first thoroughly mixing the dispersing agent and coal powders and then adding the petroleum oil thereto and stirring and mixing the resulting mixture, or by mixing and stirring coal powders, the dispersing agent and the petroleum oil in a given mixture ratio by means of a proportional introducing pump. The mixer to be used for the mixing is not particularly limited, but a colloid mill, a homogenizer, or a ultrasonic stirrer is preferable.

The composition of the coal dispersing oil consists of 10–90% by weight of coal powders, 10–90% by weight of petroleum oil and 0.01–5% by weight of the surface active agent, and is preferred to be 40–70% by weight of coal powders, 30–60% by weight of petroleum oil and 0.1–2% by weight of the surface active agent.

The coal dispersing oil compositions of the present invention are mostly liquid but some of the compositions exist in the form of a thixotropic gel. In the coal dispersing oil having the thixotropic gel form, even if the vessel is broken or tumbled and the coal dispersing oil flows out, the gel state is maintained and the coal dispersing oil does not broadly diffuse. The coal dispersing oil shows fluidity upon stirring with a small force, and can be transported by pipe.

The invention will be further explained in detail by the following example which is not limitative of the invention.

Example

As coal powders, use was made of anthracite produced from Vietnum, bituminous coal produced from China, bituminous coal produced from Australia and bituminous coal produced from Indonesia.

As petroleum oil, use was made of fuel oil produced from the Middle East, fuel oil produced from Indonesia and crude oil produced from Indonesia.

To the petroleum oil was added a surface active agent and the mixture was thoroughly stirred to dissolve the surface active agent. Then coal powders having a particle size of 33–74$\mu$ were added thereto and the mixture was vigorously mixed at 8,000–10,000 rpm for 5 minutes by means of a homogenizer to obtain a coal dispersing oil. The resulting coal dispersing oil was left to stand in a thermostat at 60° C. and the stability was measured.

The coal dispersing oil was stirred lightly with a glass bar, and the state where the stirring could be effected without resistance was judged as "stable". The results are shown in the following Table.

Table 1(a)

| No. | (1) Coal (%) | (2) Petroleum oil (%) | Surface active agent | (3) (%) | Stability |
|---|---|---|---|---|---|
| 1 | R 50 | M 50 | None | | within one day |
| 2 | S 50 | K 50 | None | | within one day |
| 3 | P 60 | L 40 | None | | within one day |
| 4 | S 49.5 | K 50 | polyoxyethylene(10)nonylphenyl ether | 0.5 | within one day |
| 5 | S 49.5 | K 50 | polyoxyethylene(10)lauryl ether | 0.5 | within one day |
| 6 | Q 39 | L 60 | polyoxyethylene(3)lauryl ether | 1 | within one day |
| 7 | R 49.5 | M 50 | polyoxyethylene(4)polyoxypropylene(4)nonylphenyl ether | 0.5 | within one day |
| 8 | S 49.5 | K 50 | lauryl ethanolamine | 0.5 | within one day |
| 9 | S 49.5 | M 50 | polyoxyethylene(5)laurylamine | 0.5 | within one day |
| 10 | P 49.5 | K 50 | monocapryl phosphate | 0.5 | more than 90 days |
| 11 | S 49.7 | M 50 | mixture of mono- and di-2-ethylhexyl phosphate | 0.3 | more than 90 days |
| 12 | Q 59.5 | M 40 | di[polyoxyethylene(10)lauryl ether] phosphate | 0.5 | more than 90 days |
| 13 | S 49.7 | K 50 | mono[polyoxyethylene(2)polyoxypropylene(4)lauryl ether] phosphate | 0.3 | more than 90 days |
| 14 | S 49.6 | K 50 | mono[polyoxyethylene(10)sorbitan monolaurate] phosphate | 0.4 | more than 90 days |
| 15 | R 49.5 | M 50 | triethanolamine mixture of mono- and dicoco phosphate | 0.5 | more than 90 days |
| 16 | R 49.5 | M 50 | diethanolamine mixture of mono- and di[polyoxyethylene(10)nonylphenyl ether] phosphate | 0.5 | more than 90 days |

Table 1(b)

| No. | (1) Coal (%) | (2) Petroleum oil (%) | Surface active agent | (3) (%) | Stability |
|---|---|---|---|---|---|
| 17 | Q 49.5 | M 50 | triethanolamine di[polyoxypropylene(3)cetyl ether] phosphate | 0.5 | more than 90 days |
| 18 | S 59.5 | K 40 | dimethyl ethanolamine di[ethylene glycol monomyristate] phosphate | 0.5 | more than 90 days |
| 19 | R 49.7 | M 50 | ethylenediamine mixture of mono- and di-2-ethylhexyl phosphate | 0.3 | more than 90 days |
| 20 | S 49.6 | K 50 | lauryl dimethylamine mono[polyoxyethylene(12)sorbitan monotallow ester] phosphate | 0.4 | more than 90 days |
| 21 | P 54.7 | L 45 | monoethanolamine monooleyl phosphate | 0.3 | more than 90 days |
| 22 | S 49.5 | K 50 | sodium mixture of mono- and di[polyoxyethylene(10)nonylphenyl ether] phosphate | 0.5 | more than 90 days |
| 23 | R 39 | L 60 | calcium dicoco phosphate | 1 | more than 90 days |
| 24 | S 59.5 | K 40 | aluminum mono[polyoxyethylene(3)polyoxypropylene-(3)nonylphenyl ether] phosphate | 0.5 | more than 90 days |
| 25 | R 59.4 | M 40 | potassium mixture of mono- and di[polyoxypropylene(4)capryl ether] phosphate | 0.6 | more than 90 days |
| 26 | Q 49.6 | M 50 | magnesium mixture of mono- and di[ethylene glycol monomyristate] phosphate | 0.4 | more than 90 days |
| 27 | S 49.5 | K 50 | zinc mono[polyoxyethylene(10) sorbitan monolaurate] | 0.5 | more than |

-continued

| | | | | | |
|---|---|---|---|---|---|
| | | | phosphate | | 90 days |
| 28 | Q 49.6 | L 50 | monoethanolamine di-2-ethylhexyl phosphate | 0.2 | more than |
| | | | calcium monococo phosphate | 0.2 | 90 days |

Table 1(c)

| No. | (1) Coal (%) | (2) Petroleum oil (%) | Surface active agent | (3) (%) | Stability |
|---|---|---|---|---|---|
| 29 | S 49.5 | L 50 | α-sulfonated hydrogenated tallow fatty acid | 0.5 | more than 90 days |
| 30 | P 59.5 | M 40 | α-sulfonated hydrogenated tallow methyl ester | 0.5 | more than 90 days |
| 31 | R 49.5 | M 50 | petroleum sulfonic acid | 0.5 | more than 90 days |
| 32 | S 49.5 | K 50 | calcium dodecylbenzene sulfonate | 0.5 | more than 90 days |
| 33 | P 59.7 | L 40 | sodium di-2-ethylhexyl sulfosuccinate | 0.3 | more than 90 days |
| 34 | R 49.5 | M 50 | sodium α-sulfonated hydrogenated tallow methyl ester | 0.5 | more than 90 days |
| 35 | R 49.7 | K 50 | dodecylbenzene sulfonic acid | 0.15 | more than 90 days |
| | | | sodium di-2-ethylhexyl sulfosuccinate | 0.15 | more than 90 days |
| 36 | S 49.5 | K 50 | diethanolamine lauryl sulfate | 0.5 | more than 90 days |
| 37 | P 39 | L 60 | ammonium polyoxyethylene(3)nonylphenyl ether sulfate | 1 | more than 90 days |
| 38 | R 49.5 | M 50 | sodium mixture of $C_{14}$ and $C_{15}$ alkyl sulfate | 0.5 | more than 90 days |
| 39 | Q 49.7 | L 50 | α-sulfonated hydrogenated tallow fatty acid | 0.15 | more than 90 days |
| | | | mono-2-ethylhexyl phosphate | 0.15 | more than 90 days |
| 40 | R 49.7 | L 50 | calcium α-sulfonated hydrogenated coco methyl ester | 0.2 | more than 90 days |
| | | | barium dicoco phosphate | 0.1 | more than 90 days |

Note:
(1) P: Anthracite produced from Vietnam,
Q: Bitaminous coal produced from China,
R: Bituminous coal produced from Australia,
S: Bituminous coal produced from Japan.
(2) K: Fuel oil produced from the Middle East,
L: Fuel oil produced from Indonesia,
M: Crude oil produced from Indonesia.
(3) Numeral value in ( ) is the number of addition mole of ethylene oxide or propylene oxide.

Nos. 1–3 were cases where no surface active agent was used and coal powders precipitated within one day.

Nos. 4–9 were cases where nonionic surface active agents commonly used as the dispersing agent were used. Coal powders precipitated within one day.

Nos. 10–40 were cases where a surface active agent selected from phosphoric esters, salts of phosphoric esters, organic sulfonic acids, salts of organic sulfonic acids, sulfuric esters and salts of sulfuric esters was used as the dispersing agent. These compositions were stable for more than 90 days.

The coal dispersing oils of the present invention were mostly liquid but the coal dispersing oil (No. 11) using 2-ethylhexyl phosphate showed a thixotropic gel form and became fluid by light stirring.

What is claimed is:

1. Coal dispersing oil compositions containing 30–60% by weight of a petroleum oil, 40–70% by weight of coal powders and 0.01–5% by weight of at least one surface active agent selected from the group of compounds consisting of alkyl esters of sulfosuccinic acids, alkenyl esters of sulfosuccinic acids, α-sulfonated fatty acids, α-sulfonated fatty acid alkyl esters, and metal and amine salts of these compounds.

2. The compositions as claimed in claim 1, wherein the coal powders are anthracite or bituminous coal.

3. The compositions as claimed in claim 1, wherein the petroleum oil is crude oil, fuel oil or gas oil.

4. A coal dispersing oil composition containing 30–60% by weight of a petroleum oil, 40–70% by weight of coal powders and 0.01–5% by weight of at least one surface active agent that is a phosphoric ester selected from the group consisting of monocapryl phosphate, mono-2-ethylhexyl phosphate, di-2-ethylhexyl phosphate, di[polyoxyethylene(10)lauryl ether] phosphate, mono [polyoxyethylene(2)polyoxypropylene(4-)lauryl ether] phosphate, mono[polyoxyethylene(10-)sorbitan monolaurate] phosphate, triethanolamine mixture of mono- and dicoco phosphate, diethanolamine mixture of mono- and di[polyoxyethylene(10)nonylphenyl ether] phosphate, triethanolamine di[polyoxypropylene(3)cetyl ether] phosphate, dimethyl ethanolamine di[ethylene glycol monomyristate] phosphate, ethylenediamine mixture of mono- and di-2-ethylhexyl phosphate, lauryl dimethylamine mono[polyoxyethylene(12)sorbitan monotallow ester] phosphate, monoethanolamine monoleyl phosphate, sodium mixture of mono- and di[polyoxyethylene(10) nonylphenyl ether] phosphate, calcium dicoco phosphate, aluminum mono[polyoxyethylene(3)polyoxypropylene-(3)nonylphenyl ether] phosphate, potassium mixture of mono- and di[polyoxypropylene(4)capryl ether] phosphate, magnesium mixture of mono- and di[ethylene glycol monomyristate] phosphate, zinc mono[polyoxyethylene(10)sorbitan monolaurate] phosphate, monoethanolamine di-2-ethylhexyl phosphate and calcium monococo phosphate, α-sulfonated hydrogenated tallow fatty acid mono-2-ethylhexyl phosphate, and calcium α-sulfonated hydrogenated coco methyl ester barium dicoco phosphate.

5. The compositions as claimed in claim 4, wherein the coal powders are anthracite or bituminous coal.

6. The compositions as claimed in claim 4, wherein the petroleum oil is crude oil, fuel oil or gas oil.

7. A coal dispersing oil composition containing 40–60% by weight of a petroleum oil, 39–59.7% by weight of coal powders and 0.01–5% by weight of at least one surface active agents selected from the group of compounds consisting of alkyl esters of sulfosuccinic acids, alkenyl esters of sulfosuccinic acids, α-sulfonated fatty acids, α-sulfonated fatty acid alkyl esters, and metal and amine salts of these compounds.

8. A coal dispersing oil composition containing 40–60% by weight of a petroleum oil, 39–59.7% by weight of coal powders and 0.01–5% by weight of at least one surface active agent that is a phosphoric ester selected from the group consisting of monocapryl phosphate, mono-2-ethylhexyl phosphate, di-2-ethylhexyl phosphate, di[polyoxyethylene(10)lauryl ether] phosphate, mono[polyoxyethylene(2)polyoxypropylene(4-)lauryl ether] phosphate, mono[polyoxyethylene(10-)sorbitan monolaurate] phosphate, triethanolamine mixture of mono- and dicoco phosphate, diethanolamine mixture of mono- and di[polyoxyethylene(10)nonylphenyl ether] phosphate, triethanolamine di[polyoxypropylene(3)cetyl ether] phosphate, dimethyl ethanolamine di[ethylene glycol monomyristate] phosphate, ethylenediamine mixture of mono- and di-2-ethylhexyl phosphate, lauryl dimethylamine mono[polyoxyethylene(12)sorbitan monotallow ester] phosphate, monoethanolamine monoleyl phosphate, sodium mixture of mono- and di[polyoxyethylene(10)nonylphenyl ether] phosphate, calcium dicoco phosphate, aluminum mono[polyoxyethylene(3)polyoxypropylene-(3)nonylphenyl ether] phosphate, potassium mixture of mono- and di[polyoxypropylene(4)capryl ether] phosphate, magnesium mixture of mono- and di[ethylene glycol monomyristate] phosphate, zinc mono[polyoxyethylene(10)sorbitan monolaurate] phosphate, monoethanolamine di-2-ethylhexyl phosphate and calcium monococo phosphate, α-sulfonated hydrogenated tallow fatty acid mono-2-ethylhexyl phosphate, and calcium α-sulfonated hydrogenated coco methyl ester barium dicoco phosphate.

9. A coal dispersing oil composition containing 10–90% by weight of a petroleum oil, 10–90% by weight of coal powders and 0.01–5% by weight of at least one surface active agents selected from the group of compounds consisting of alkyl esters of sulfosuccinic acids, alkenyl esters of sulfosuccinic acids, α-sulfonated fatty acids, α-sulfonated fatty acid alkyl esters, and metal and amine salts of these compounds.

10. A coal dispersing oil composition containing 10–90% by weight of a petroleum oil, 10–90% by weight of coal powders and 0.01–5% by weight of at least one surface active agent that is a phosphoric ester selected from the group consisting of monocapryl phosphate, mono-2-ethylhexyl phosphate, di-2-ethylhexyl phosphate, di[polyoxyethylene(10)lauryl ether] phosphate, mono[polyoxyethylene(2)polyoxypropylene(4-)lauryl ether] phosphate, mono[polyoxyethylene(10-)sorbitan monolauratel] phosphate, treithanolamine mixture of mono- and dicoco phosphate, diethanolamine mixture of mono- and di[polyoxyethylene(10-)nonylphenyl ether] phosphate, triethanolamine di[-polyoxypropylene(3)cetyl ether] phosphate, dimethyl ethanolamine di[ethylene glycol monomyristate] phosphate, ethylenediamine mixture of mono- and di-2-ethylhexyl phosphate, lauryl dimethylamine mono[-polyoxyethylene(12)sorbitan monotallow ester] phosphate, monoethanolamine monoleyl phosphate, sodium mixture of mono- and di[polyoxyethylene(10) nonylphenyl ether] phosphate, calcium dicoco phosphate, aluminum mono[polyoxyethylene(3)polyoxypropylene-(3)nonylphenyl ether] phosphate, potassium mixture of mono- and di[polyoxypropylene(4)capryl ether] phosphate, magnesium mixture of mono- and di[ethylene glycol monomyristate] phosphate, zinc mono[polyoxyethylene(10)sorbitan monolaurate] phosphate, monoethanolamine di-2-ethylhexyl phosphate and calcium monococo phosphate, α-sulfonated hydrogenated tallow fatty acid mono-2-ethylhexyl phosphate, and calcium α-sulfonated hydrogenated coco methyl ester barium dicoco phosphate.

* * * * *